United States Patent [19]

Furukawa et al.

[11] Patent Number: 5,056,299

[45] Date of Patent: Oct. 15, 1991

[54] APPARATUS FOR OPENING AND PLACING BAGS ON A FILLING HOPPER

[75] Inventors: Takao Furukawa; Hiroyoshi Odawara, both of Onomichi, Japan

[73] Assignee: ECS Corporation, Hiroshima, Japan

[21] Appl. No.: 520,781

[22] Filed: May 8, 1990

[30] Foreign Application Priority Data

Jun. 30, 1989 [JP] Japan ..... 1-170924

[51] Int. Cl.[5] ..... B65B 43/18; B65B 43/30

[52] U.S. Cl. ..... 53/571; 53/258; 53/385.1; 53/386.1

[58] Field of Search ..... 53/384, 385, 386, 570, 53/571, 573, 258

[56] References Cited

U.S. PATENT DOCUMENTS

| | | | |
|---|---|---|---|
| 2,781,620 | 2/1957 | Hopkins et al. | 53/571 X |
| 2,950,589 | 8/1960 | Litchard | 53/385 |
| 3,273,471 | 9/1966 | Dollheimer | 53/585 X |
| 3,287,879 | 11/1966 | Miller | 53/386 |
| 3,363,397 | 1/1968 | Lespeau | 53/386 |
| 3,501,893 | 3/1970 | Peterson | 53/573 |
| 3,577,704 | 5/1971 | Lense | 53/570 X |
| 3,698,451 | 10/1972 | Hudson | 53/571 X |
| 4,086,746 | 5/1978 | Christy | 53/571 |
| 4,211,053 | 7/1980 | Niccolls | 53/571 X |
| 4,779,403 | 10/1988 | Perrucchini | 53/573 |

*Primary Examiner*—Robert L. Spuill
*Assistant Examiner*—Daniel B. Moon
*Attorney, Agent, or Firm*—Joseph W. Farley

[57] ABSTRACT

An apparatus for successively opening the mouths of bags which are fed one by one to a table and putting such bag over a guide hopper for charging the bag with an article to be packaged. The mouth of the bag is sucked by a pair of vacuum suction members from the opposite sides. The vacuum suction members are gradually separated from each other while transferring a bag from a table to the hopper, thereby gradually opening the mouth of the bag. This prevents failures in opening bags and also prevents the bag from separating from the vacuum suction members.

4 Claims, 6 Drawing Sheets

APPARATUS FOR OPENING AND PLACING BAGS ON A FILLING HOPPER

FIELD OF THE INVENTION

The present invention relates to an apparatus for efficiently putting a bag over the mouth of a guiding hopper for charging bags with an article to be packaged.

BACKGROUND OF THE INVENTION

When it is desired to charge a bag with an article to be packaged, it is known from experience that however wide the mouth of the bag may be opened, the article tends to spill; thus, it has been common practice to use a nozzle or hopper to satisfactorily charge bags with articles. For example, U.S. Pat. No. 2,833,097 discloses an apparatus designed to place a stack of bags in a bag storage box, remove the endmost bag from the stack by a vacuum cup, and put the removed bag over a suspended hopper, and U.S. Pat. No. 3,945,173 discloses an apparatus designed to open a bag placed on a table by sucking the mouth of the bag by a pair of vacuum cups, insert a split circular member into the opened mouth to maintain the bag mouth in the opened state by means of said round member, and put said bag over a suspended hopper.

U.S. Pat. No. 2,833,097 states that the mouth of the endmost bag is opened when said bag is separated from the rest of the bags stacked in the bag storage box when it is sucked by the vacuum cup. However, such bags cannot always be completely opened; failures in opening bags take place.

On the other hand, since U.S. Pat. No. 3,945,173 is adapted to open bags by sucking the opposite sides of the mouth of a bag by a pair of vacuum cups and separating the vacuum cups from each other to open the mouth, the number of failures in opening bags is certainly reduced. However, plastic films which form bags tend to be charged with electricity on the one hand and on the other hand negative pressure tends to be produced in bags when they are forced to open quickly, with the result that the bag surface often tends to separate from the vacuum cups. Therefore, said two known apparatuses have a drawback in that they cannot reliably put bags over the hopper unless the working efficiency is decreased.

DISCLOSURE OF THE INVENTION

Accordingly, an object of the present invention, which is intended to solve such problems, is to reduce the number of failures in opening bags so as to reliably put them over a hopper.

To achieve this object, an apparatus according to the invention for successively opening the mouths of bags which are fed one by one to a table and putting such bag over a guide hopper for charging the bag with an article to be packaged, comprises:

a pair of vacuum suction cups capable of vacuum-sucking the mouth of a bag, fed to said table, from its opposite sides, means for moving said vacuum suction means from said table to the hopper, guide means adapted to engage said pair of vacuum suction means when the latter move between said table and said hopper so as to fix the relative position of said pair of vacuum suction means, said guide means being adapted to gradually separate said pair of vacuum suction means from each other to open the mouth of a bag in operative association with the movement of said pair of vacuum suction means while said pair of vacuum suction means are moved from said table to said hopper.

According to such arrangement, sufficient time to open the mouth of a bag is allowed and the number of failures in opening bags is reduced to a minimum without having to decrease the capacity of feeding bags to the hopper, as compared with the system in which the mouth of a bag is opened at a stop position and said bag is conveyed to the hopper, as described above.

DESCRIPTION OF EMBODIMENTS

Figure 1:
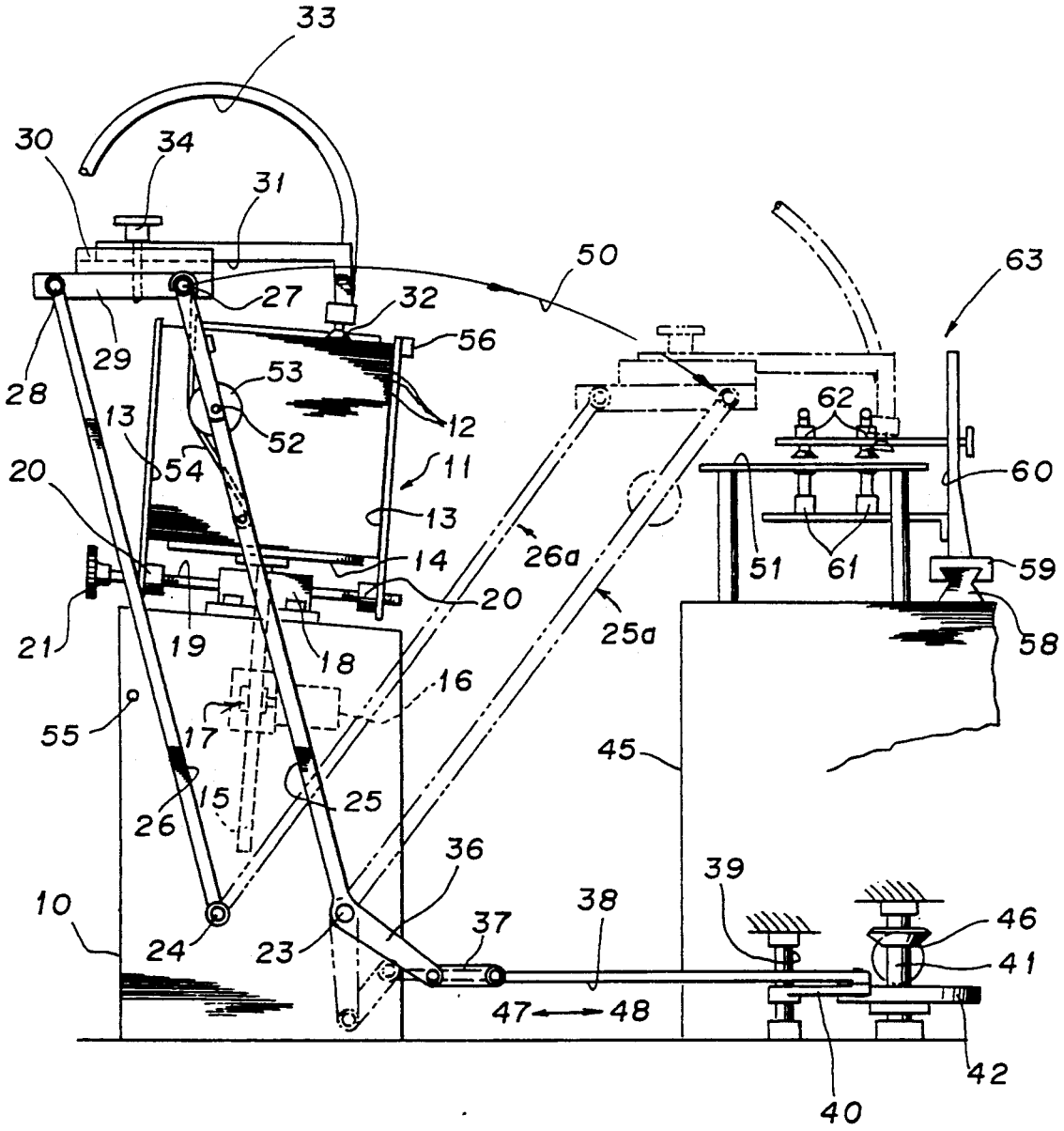
FIG. 1 is a rear view of an embodiment of an apparatus according to the invention.

FIG. 1 shows a number of bags 12 stacked in a bag storage box 11 mounted on a machine frame 10. The bag storage box 11 is formed of four walls including a pair of side walls 13, and a bottom disk 14, wherein a toothed rack 15 depending from the center of said bottom disk 14 is engaged by a pinion 17 mounted on the shaft of a motor 16 fixed on the machine frame 10. A turnbuckle screw 19 is rotatably supported in a bearing 18 mounted on the upper surface of the machine frame 10, and internally threaded sockets 20 on the opposite side walls 13 are threadedly engaged on the turnbuckle screw 19. Thus, by turning the turnbuckle screw 19 by a handle 21, the distance between the opposite side walls 13 can be adjusted according to the width of the bags 12.

Two links 25 and 26 are pivotally supported at their lower ends on the machine frame 10 by pins 23 and 24, and a seat plate 29 is supported on the upper ends of said links by pins 27 and 28 while the links are maintained parallel with each other. An arm 31 is slidably supported in a guide groove 30 formed on the upper surface of said seat plate 29. A vacuum cup 32 is installed on the front end of the arm 31 and directed downward. The vacuum cup 32 is connected to a vacuum pump through a tube 33 so that a vacuum suction force is produced in the vacuum cup 32. The arm 31 is fixed on the seat plate 29 by a clamping force produced by a threaded rod 34, and when the threaded rod 34 is loosened, the arm 31 is allowed to slide along the guide groove 30.

The lower end of the link 25 disposed on one side is extended to form a lever 36 having two connecting members 37 and 38 connected in series thereto, the end of the connecting member 38 being connected to a swing lever 40 pivotally supported on a shaft 39. The swing lever 40 is engaged with a grooved cam 42 fixed on the main shaft 41. Though not shown, the longer connecting member 38 is supported in a sleeve fixed on the machine frame 45. Torque is transmitted to the grooved cam 42 through an input gear 46 to swing the swing lever 40 in a fixed cycle to reciprocate the connecting member 38 as indicated by arrows 47 and 48, whereby the parallel links 25 and 26 are reciprocated between a position shown in solid lines and a position shown in phantom lines 25*a*, 26*a*.

A valve placed in the tube 33 is operated to apply a suction force to the vacuum cup 32 only during the time the parallel links 25 and 26 are moving in the direction of arrow 50. Thus, the bags 12 in the bag storage box 11 are transferred one by one at fixed intervals of time to the table 51 on the machine frame 45 with the uppermost bag being taken out first.

Of the two parallel links, one link 25 is formed at the upper portion thereof with an articulate portion 52, the bending of said articulate portion 52 being prevented by the resilient force of a coiled spring 54 entrained around a reel 53. When the other link 26 abuts against a stop 55 and is thereby prevented from further moving, the articulate portion 52 is bent against the resilient force of the spring 54, thereby pressing the vacuum cup 32 more strongly against the upper surface of the bag 12. As the bags 12 are transferred, the number of bags 12 decreases, until the shadow of the bags no longer covers a photoelectric switch 56, whereupon the motor 16 is rotated to raise the bottom disk 14 carrying bags 12 thereon until the photoelectric switch 56 detects bags, whereupon the motor 16 is stopped.

The device for taking out stacked bags one by one is arranged as described above.

Figure 2:
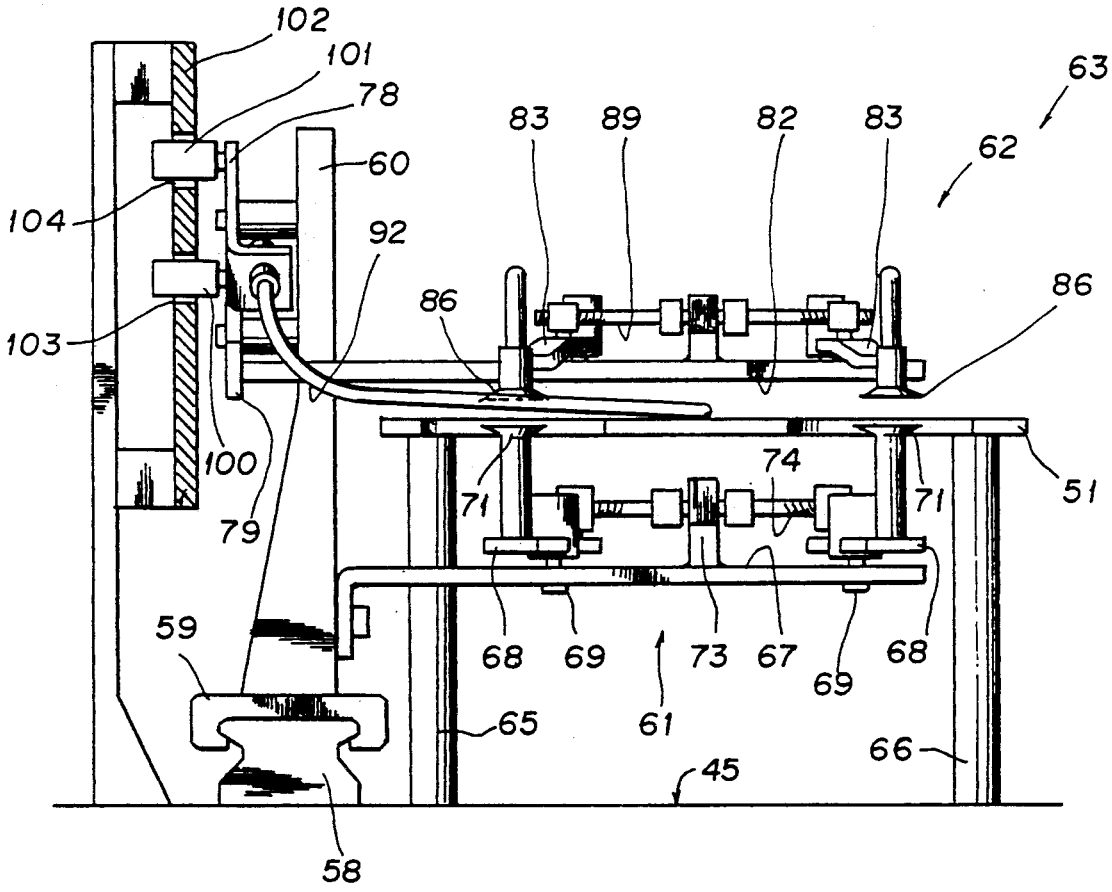
FIG. 2 is a front view of the principal portion of said apparatus.
Figure 3:
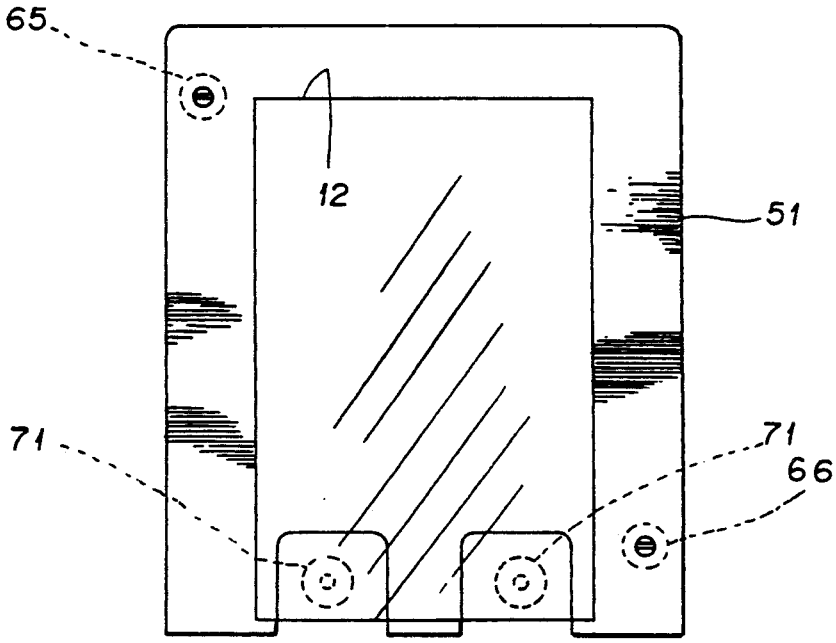
FIG. 3 is a plan view of a table shown in FIG. 2.

Installed on the machine frame 45 adjoining the taking-out device is a bag opening device 63 having suction heads 61 and 62 disposed on a pillar 60 erected on a guide body 59 adapted to slide along a rail 58. FIG. 2 is a front view of said bag opening device 63. On the machine frame 45, the table 51 is supported on two legs 65 and 66. As shown in FIG. 3, the two legs 65 and 66 are disposed on a diagonal of the table 51 to see that there will be no interference with the movement of the bag opening device.

Figure 4:
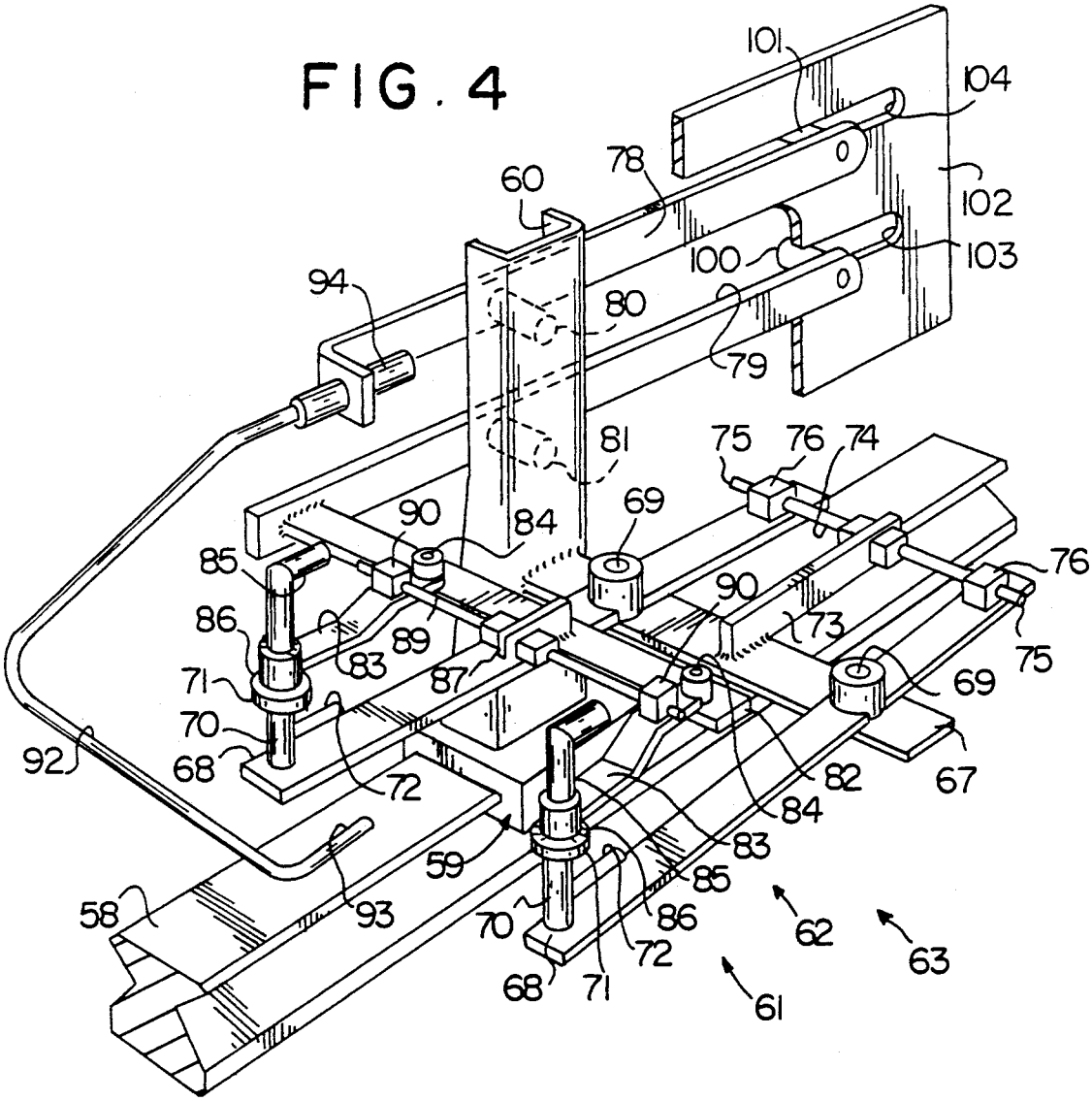
FIG. 4 is a perspective view of the portion shown in FIG. 2.

As shown also in FIG. 4, two arms 68 are horizontally rotatably supported at their middle regions by pins 69 on a support member 67 which is fixed on the lateral surface of the pillar 60 and transversely extends. Vacuum cups 71 are installed on the upper ends of short pipes 70 erected on the front ends of the arms 68, thereby forming the lower suction head 61. Connectors 72 for hoses are formed on the lateral surfaces of the pipes 70 so that the cups 71 are evacuated through the hoses.

A turnbuckle screw 74 is rotatably supported in a bracket 73 rearwardly extending from the support member 67, said turnbuckle 74 having externally threaded portions 75 on its opposite ends and having fitted thereon internally threaded sockets 76 installed on the arms 68. Therefore, rotatively operating the turnbuckle screw 74 makes it possible to adjust the distance between the vacuum cups 71 disposed on the front ends of the arms 68 according to the width of bags 12.

Two levers 78 and 79 are vertically swingably supported on the rear side of the pillar 60 by pins 80 and 81. A support member 82 laterally extends from the front end of the lower lever 79 and pivotally supports two arms 83 on its upper surface by pins 84, while vacuum cups 86 are installed on the lower ends of pipes 85 fixed on the front ends of said arms 83, thereby forming the upper suction head 62. Hoses are connected to the pipes 85 so that vacuum suction forces are produced in the vacuum cups 86. A turnbuckle screw 89 is rotatably supported in a bracket 87 installed on the support member 82. External threads formed in the opposite ends of the turnbuckle screw 89 are engaged with internally threaded sockets 90 installed on the arms 83 so that the distance between the vacuum cups 86 can be adjusted by operating the turnbuckle screw 89.

A pipe 92 is fixed on the front end of the upper lever 78, the front end 93 of said pipe 92 being opposed to the space between the suction hands 61 and 62 so that the compressed air being fed through a hose connected to the base end 94 of the pipe 92 is blown out of the front end 93 of the pipe to assist in opening the mouth of the bag.

Figure 5:
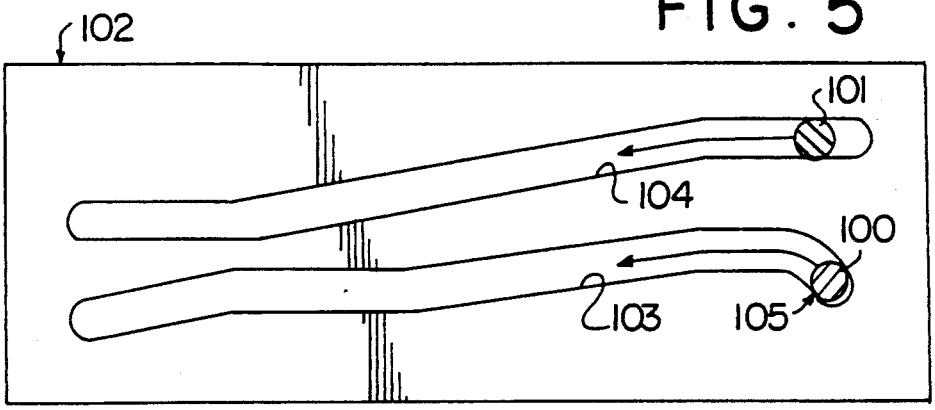
FIG. 5 is a front view of a cam plate shown in FIGS. 2 and 4.

As shown in FIG. 2, rollers 100 and 101 rotatably mounted on the base ends of the levers 78 and 79 are engaged in the grooves 103 and 104 of a cam plate 102 disposed beside the rail 58. Although the means for moving the guide body 59 is omitted from the drawings, it may be an air cylinder or the like adapted to reciprocate the guide body 59 along the rail 58. As shown in FIG. 5, the cam grooves 103 and 104 are downwardly inclined as the rollers 100 and 101 are moved in the direction of arrows. In FIG. 4, as the rollers 100 and 101 are moved downward, the front ends of the levers 78 and 79 are turned upward around the axes of the pins 80 and 81. While the lower vacuum cups 71 are reciprocated at a constant height, the upper vacuum cups 86 and the front end 93 of the pipe are moved upward when the guide body 59 is advanced. Reversely they are moved downward when it is retracted.

Figure 6:
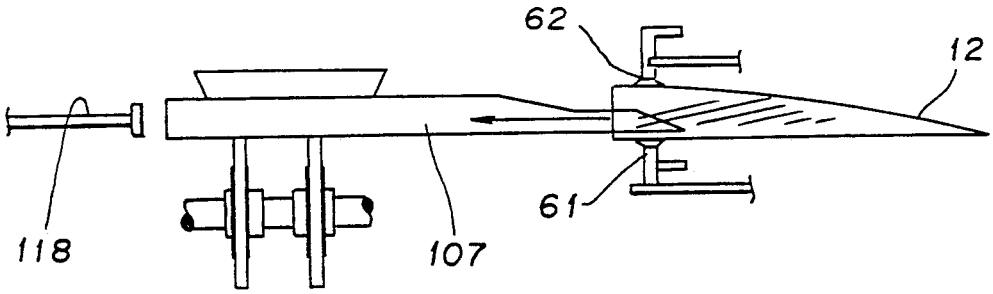
FIG. 6 is a side view of a hopper and its surroundings in an embodiment of an invention according to the invention.

Particularly, since the rear end 105 of the lower cam groove 103 is inclined upward extremely sharply as shown in FIG. 5, the mouth edge of the bag 12 placed on the table 51 is nipped between the upper and lower vacuum cups 86 and 71 as shown in FIG. 3 and sucked by these vacuum cups. And the suction heads 61 and 62 remove the bag 12 from the table 51 while opening the bag mouth, and put the bag over a hopper 107 at rest as shown in FIG. 6.

In this case, since the upper and lower vacuum cups 86 and 71 gradually open the bag as they move toward the hopper 107, there is little or no possibility of a negative pressure being produced in the bag, and even if the bag is electrically charged, it can be reliably opened.

Figure 7:
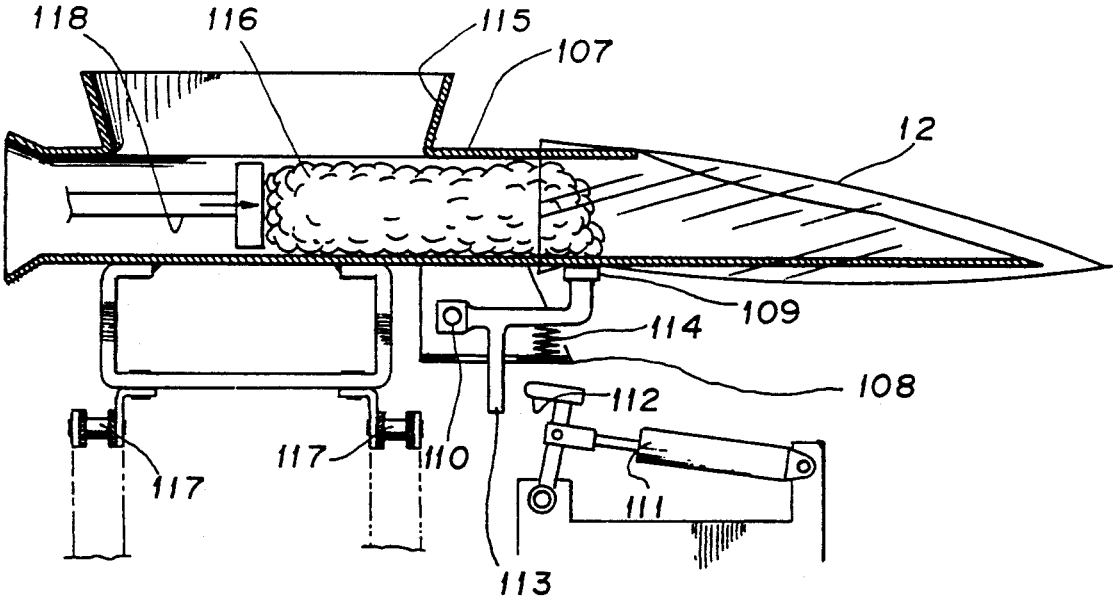
FIG. 7 is an enlarged sectional view of the hopper of FIG. 6.

As shown in FIG. 7, a clamp 109 is pivotally supported on a pin 110 on a bracket 108 disposed on the lower side of the hopper 107. A hammer 112 operated by an air cylinder 111 is adapted to push a portion 113 of the clamp to open the clamp 109 against the force of a spring 114, so that the bag 12 is brought in when the clamp is ready for reception; thus, the bag 12 can be firmly held over the hopper by the clamp 109.

Figure 8:
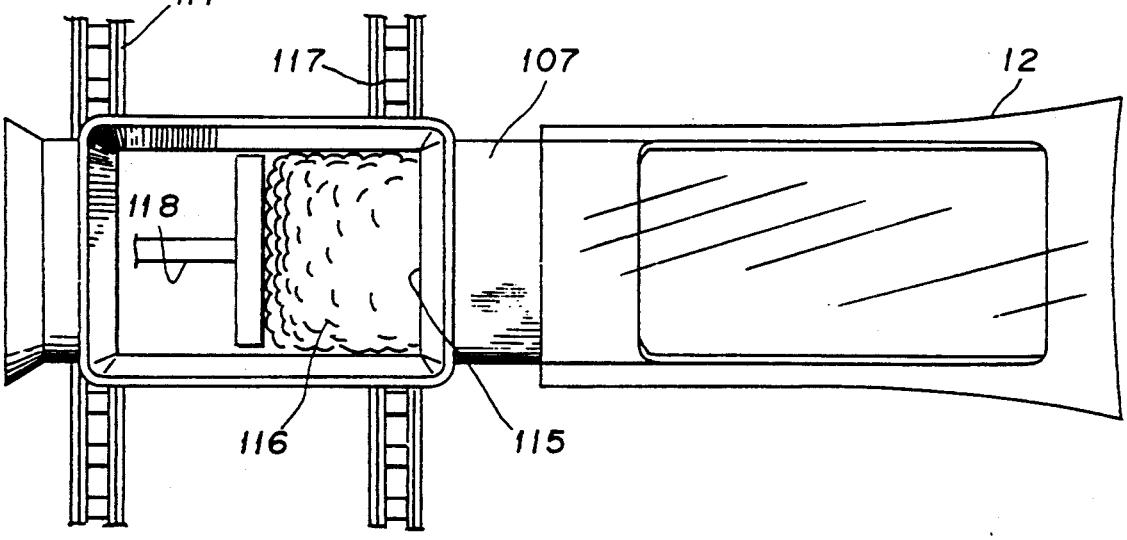
FIG. 8 is a plan view of the portion shown in FIG. 7.

The upper surface of the hopper 07 is formed with a feed port 115 through which a food 116 is fed into the hopper in advance. As shown in FIG. 8, the hopper 107 is carried on two chains 117. When the hopper 107 capped with the bag 12 is conveyed to the next position and stops there, a rod 118 disposed at said position advances into the hopper to charge the food 116 into the bag 12.

Figure 9:
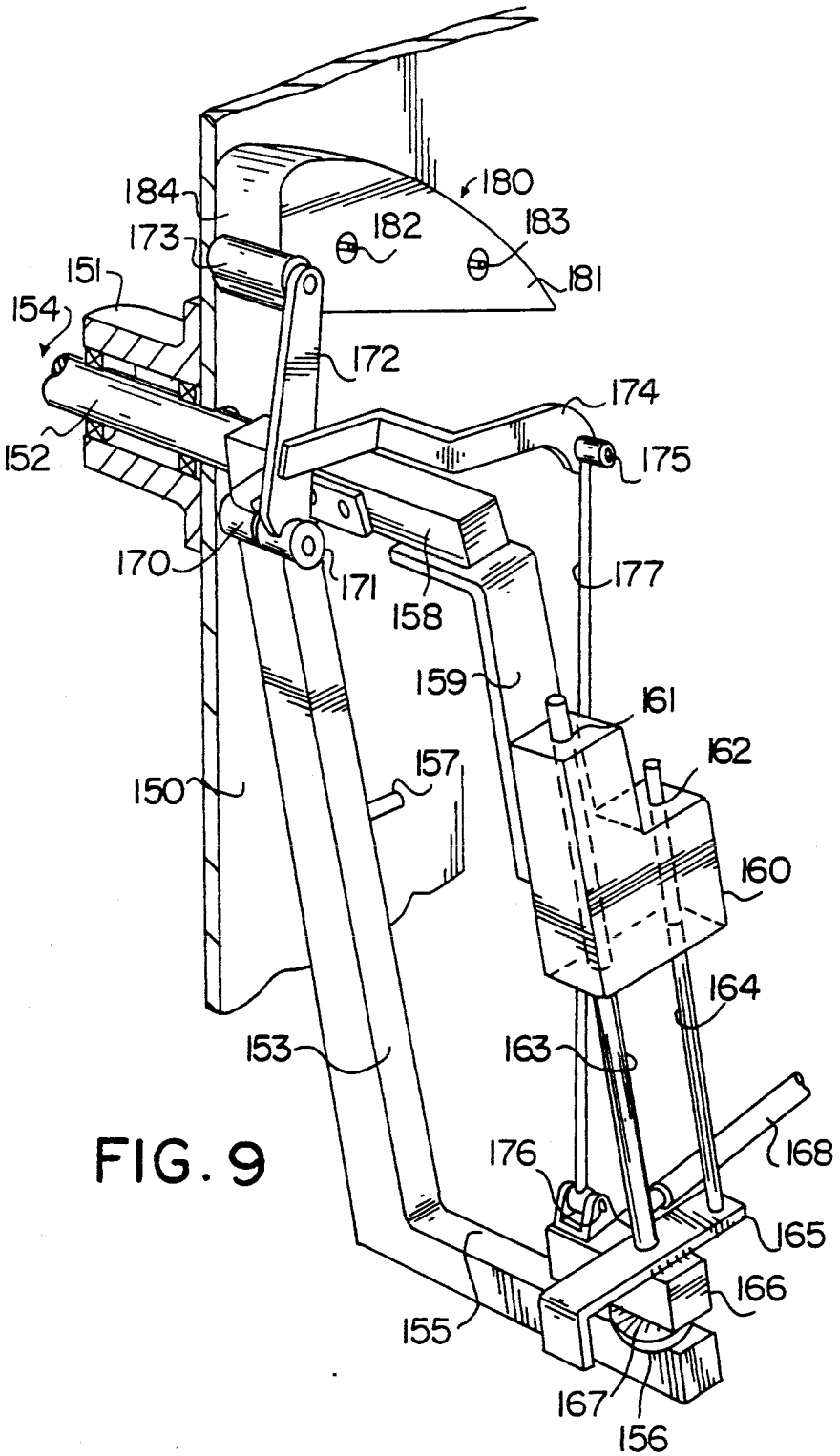
FIG. 9 is a perspective view of another embodiment of an apparatus according to the invention.
Figure 10:
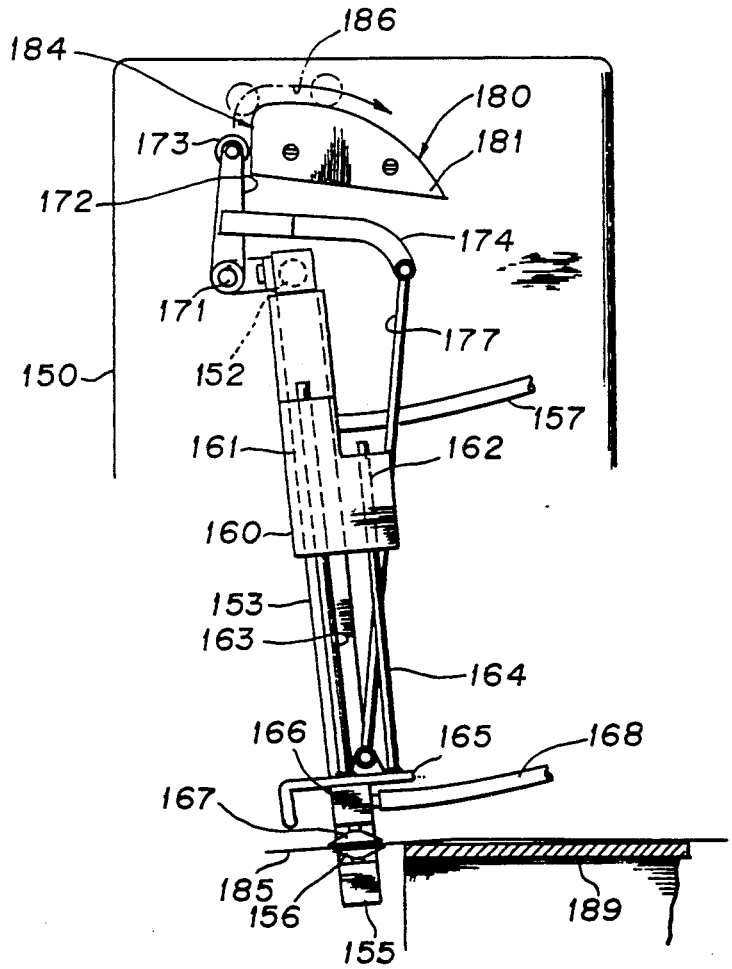
FIG. 10 is a front view of the apparatus shown in FIG. 9.
Figure 11:
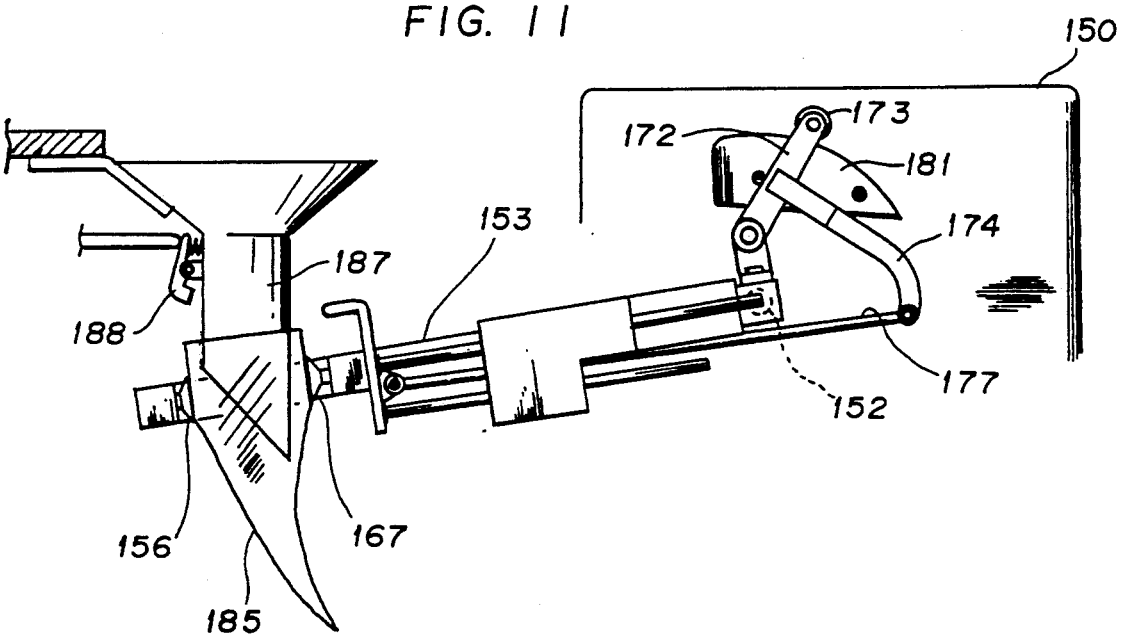
FIG. 11 is a front view showing how the apparatus shown in FIG. 10 operates.

FIGS. 9 through 11 show another embodiment of the invention.

As shown in FIG. 9, a shaft 152 is rotatably supported in a bearing 151 installed on a vertical wall 150 of the machine frame, and a channel-shaped frame 153 is fixed on the end of the shaft 152 outside the wall 150. The frame 153 is adapted to be swung by a force applied to the end 154 of the shaft 152 inside the wall 150. A first vacuum cup 156 installed on the upper surface of a horizontal support seat 155 on the lower side of the frame 153 is connected to a vacuum pump through an air passage in the frame 153 and a tube 157, so that a vacuum suction force is produced in the first vacuum cup 156 by the vacuum pump.

A guide block 160 is fixed on a portion 158 horizontally projecting from the upper end of the frame 153 by an inverted L-shaped bracket 159. As shown in FIG. 10, guide bars 163 and 164 are slidably supported in two holes 161 and 162 vertically extending through said guide block 160 and are fixed at their lower ends to a connecting plate 165. A support member 166 is fixed on the lower surface of the connecting plate 165. A second vacuum cup 167 is installed on the lower surface of the support member 166 in opposed relation to the first vacuum cup 156. The second vacuum cup 167 is connected to a vacuum pump through a passage formed in a frame 166 and a tube 168 so that a vacuum suction force is produced also in the second vacuum cup 167.

A lever 172 is rotatably supported on a pin 171 in a bearing 170 installed at the upper end of the frame 153, the upper end of said lever 172 rotatably supporting a roller 173. An arm 174 extends rearward from the intermediate portion of the lever 172 and has a pin 175 at its front end, said pin being connected to a pin 176 on a support member 166 by a bar 177. A cam 181 whose upper surface 180 is arcuate is fixed on the wall 150 of the machine frame by set screws 182 and 183. The cam 181 has a vertical guide surface 184 on the side opposed to the roller 173.

The frame 153 has a first stop position where it is suspended from the shaft 152 as shown in FIG. 10 and a second stop position which is about 90 degrees clockwise away from the FIG. 10 position. It is arranged that the frame 153 is swung between said two positions.

First, the frame 153 starts to turn clockwise from the stop position shown in FIG. 10. In this case, the roller 173 receives a reaction from the vertical guide surface 184 of the cam 181, so that the lever 172 is pushed by said guide surface 184. Therefore, the support member 166 is pulled upward by the bar 177, until the two vacuum cups 156 and 167 are separated from each other, as shown in FIG. 11. Therefore, if there is a bag 185 between the two vacuum cups, the mouth of the bag 185 is opened by the vacuum cups 156 and 167.

During the transition of the rotation of the frame 153, the roller 173 moves along a path indicated by an arrow 186 and continues to receive a reaction from the guide surface 184 for some time. Therefore, as the angle of rotation of the frame 153 increases, the distance between the vacuum cups 156 and 167 also increases. If it is arranged that even after the roller 173 has landed on the upper surface 180 of the cam 181, the roller 173 receives a reaction from said upper surface 180, then the vacuum cups 156 and 167 remain separated from each other until completion of the rotation of the frame 153.

When the bag 185 is put over the hopper 187 and is fixed in position by the clamp 188, as shown in FIG. 11, the frame 153 starts to move in the opposite direction. At the same time, the roller 173 moves in the direction opposite to that indicated by the arrow 186 in FIG. 10. When the roller 173 is displaced from the upper surface 180 of the cam 181 to the vertical guide surface 184, the second vacuum cup 167 gradually falls to the first vacuum cup 156 under the combined weight of the guide bars 163, 164 and support member 166 so that the next bag 185 on the table 189 is nipped between the vacuum cups 156 and 167. Bags are fed one by one onto the table 189 by the device shown in FIG. 1.

The area of the opening of the bag 185 effected by the vacuum cups 156 and 167 can be optionally changed by loosening the set screws 182 and 183 for the cam and turning the cam clockwise or counterclockwise to reset the same.

What is claimed is:

1. An apparatus for successively opening the mouths of bags which are fed one by one to a table and putting each bag over a guide hopper for charging the bag with an article to be packaged, comprising:

a rail extending from the table to the hopper, a guide body movable along said rail between said table and hopper, first and second vacuum suction means carried by said guide body for engaging the opposite sides of the mouth of each bag fed to said table, said first vacuum suction means having a fixed suction head provided with first vacuum cup means capable of sucking one surface of the bag, said second vacuum suction means having a movable suction head provided with second vacuum cup means capable of sucking the other surface of the bag;

said first vacuum suction means including a pillar installed on said guide body, a first support member projecting from said pillar to said table, first arm means installed on said first support member, said first vacuum cup means being installed on said first arm means;

a cam disposed alongside of said rail;

said second vacuum suction means including a lever swingably supported between its opposite ends on said guide body,, a second support member projecting from one end of said lever to said table, second arm means installed on said second support member, said second vacuum cup means being installed on said second arm means in opposed relation to said first vacuum cup means, and means on the other end of said lever for engaging said cam, said cam being adapted to gradually swing said lever to separate said second vacuum cup means from said first vacuum cup means when said guide body is moved from said table to said hopper.

2. An apparatus as set forth in claim 1, wherein each of said first and second vacuum cup means has a pair of vacuum cups whose spacing is adjustable.

3. An apparatus for successively opening the mouths of bags which are fed one by one to a table and putting each bag over a guide hopper for charging the bag with an article to be packaged, comprising:

a rail extending from the table to the hopper, a guide body movable along said rail between said table and hopper, a pair of vacuum suction means carried by said guide body for vacuum sucking the mouth of each bag, fed to said table, from its opposite surfaces, one vacuum suction means having a fixed suction head provided with first vacuum cup means capable of sucking one surface of the bag, the other vacuum suction means having a movable suction head provided with second vacuum cup means capable of sucking the other surface of the bag;

said movable suction head including a first lever and means for swingably supporting said first lever between its opposite ends, said second vacuum cup means being attached to one end of said first lever;

a cam disposed alongside of said rail, a first roller installed on the other end of said first lever, a first cam groove formed in said cam and engaged by said first roller, said first cam groove being adapted to gradually swing said lever to separate said second vacuum cup means from said first vacuum cup means when said guide body is moved from said table to said hopper, a second lever swingably supported between its opposite ends on said guide body, an air blowing pipe installed on one end of said second lever, a second roller installed on the other end of said second lever, and a second cam groove formed in said cam and engaged by said second roller, said second cam groove being adapted to swing said second lever in synchronism with the opening of the mouth of the bag effected by said first and second vacuum cup means in response to movement of said guide body whereby, when the mouth of the bag begins to be opened, said blowing pipe is brought into opposed relation to the mouth of the bag so as to feed air into the bag, and after the mouth of the bag has been opened, said blowing pipe is retracted from opposed relation to the bag mouth to a position away therefrom.

4. An apparatus for successively opening the mouths of bags which are fed one by one to a table and putting each bag over a guide hopper for charging the bag with an article to be packaged, comprising:

a pair of vacuum suction means for engaging the opposite sides of the mouth of each bag fed to said table, means for moving said vacuum suction means along an arcuate path between said table and said guide hopper including a frame rotatable on a shaft and having one of said vacuum suction means attached thereto, a connecting plate having the other of said vacuum suction means attached thereto, guide means supporting said connecting plate on said frame for separating movement between said pair of vacuum suction means, a lever rotatable on a pin installed on said frame and having an end spaced radially from said pin, connecting means extending between said lever and connecting plate, and a cam for engaging said end of said lever, said cam being adapted to actuate said lever and connecting means in a manner such that said other vacuum suction means is gradually separated from said one vacuum suction means in response to movement of said frame from said table to said guide hopper.

* * * * *